United States Patent [19]

Pichlmaier et al.

[11] Patent Number: 4,936,519

[45] Date of Patent: Jun. 26, 1990

[54] INTERNAL LINING FOR BALL MILLS

[75] Inventors: Erich Pichlmaier, Lorenzen; Manfred Zoller, Linz, both of Austria

[73] Assignee: Voest-Alpine Aktiengesellschaft, Linz, Austria

[21] Appl. No.: 714,856

[22] Filed: Mar. 22, 1985

[30] Foreign Application Priority Data

May 10, 1984 [AT] Austria ..... 1542/84

[51] Int. Cl.[5] ..... B02C 17/22

[52] U.S. Cl. ..... 241/183; 241/299

[58] Field of Search ..... 241/299, 300, 182, 183, 241/DIG. 30

[56] References Cited

U.S. PATENT DOCUMENTS 1,741,604 12/1929 Barratt ..... 241/183 X
2,268,661 1/1942 Kennedy ..... 241/183
2,967,671 1/1961 Falla ..... 241/183
2,998,201 8/1961 Ratkowski ..... 241/183

FOREIGN PATENT DOCUMENTS 283092 7/1970 Austria .
373792 2/1984 Austria .

*Primary Examiner*—Mark Rosenbaum
*Attorney, Agent, or Firm*—Cushman, Darby & Cushman

[57] ABSTRACT

An internal lining for cylindrical ball mills has riffles approximately extending in circumferential direction and webs located between the riffles and further has elevations and/or depressions arranged transversely to the circumferential direction. This allows fine grinding between the balls and the riffles. The balls are lifted to a higher level by the elevations and/or the depressions and the balls are better agitated within the heap of balls effecting coarse grinding.

7 Claims, 2 Drawing Sheets

Figure 4:
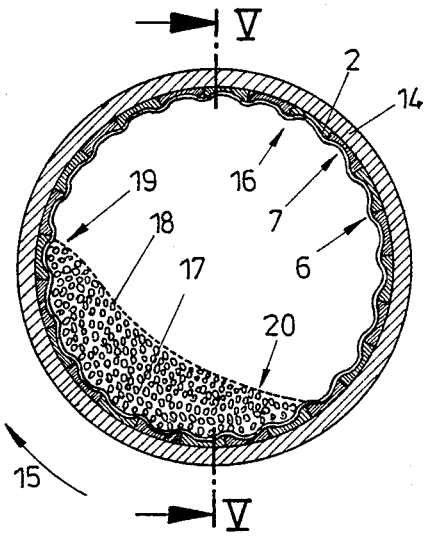

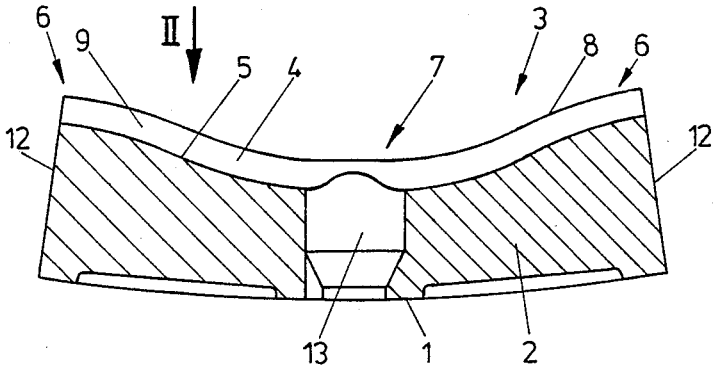
FIG. 1
FIG. 2
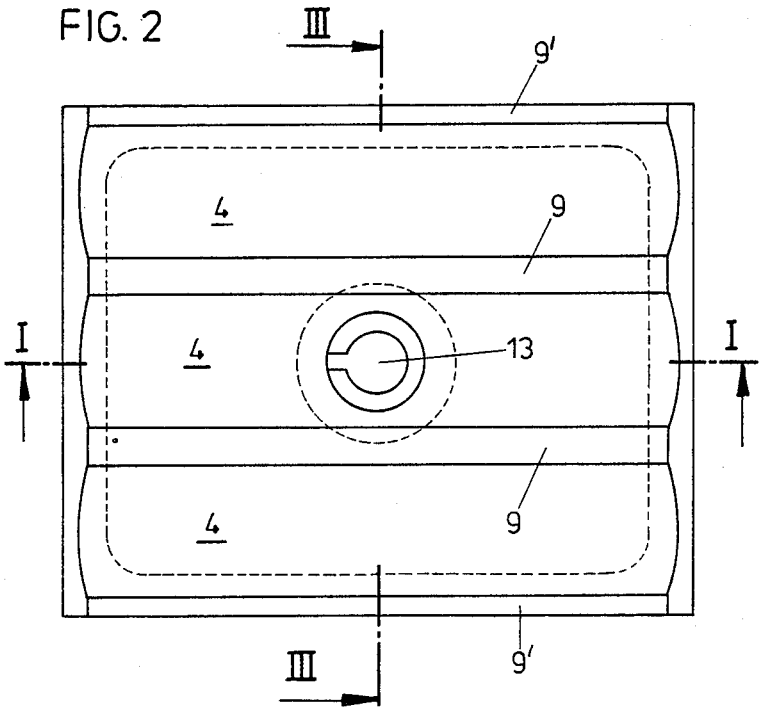
FIG. 3
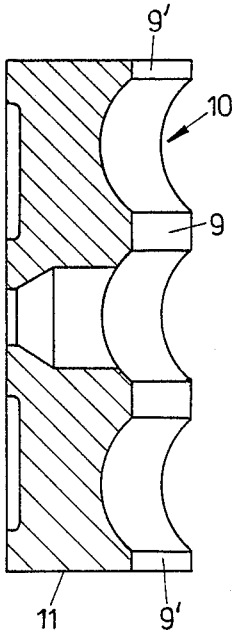

INTERNAL LINING FOR BALL MILLS

The invention refers to an internal lining for cylindrical ball mills. Such cylindrical ball mills are named tubular ball mills. The internal linings of such tubular ball mills normally consist of armor plates. If the internal lining is smooth, there is only a point contact between the balls and the internal lining. The grinding action is thus low between the balls and the internal lining and the grinding action between the balls within the heap of balls is equally low because the balls are agitated for an only minor degree on account of the smooth internal lining. On account of the balls immediately contacting the internal lining, the noise generated is considerable. It is known to provide the internal lining with riffles extending approximately in circumferential direction and having, as seen in a cross section, a profile showing a radius of curvature which—in known ball mills approximately corresponds to the radius of curvature of the biggest ball, noting that webs exist between said riffles. Within these riffles, the charge to be ground is substantially prevented from evading in transverse direction of the riffles. The charge to be ground is thus maintained within the riffles as an intermediate layer between the internal lining and the balls. Thus, a line contact is established between the balls on the one hand and the riffles and the charge to be ground on the other hand. The grinding effect between the balls and the internal lining is thus substantially improved and a substantial noise reduction is achieved on account of the charge to be ground being present between the internal lining and the balls. A braking action is effected on the balls by the charge to be ground contained within the ball mill, and during rotation the balls are thus somewhat taken along, so that the heap of balls is agitated to some degree, which, however, is not sufficient for obtaining a grinding effect within the heap of balls. A grinding effect is thus mainly obtained only between the balls and the riffles of the internal lining. Such constructions are named riffle armor. It is further known to provide a smooth internal lining without any riffles but having elevations and depressions transversely arranged relative to the circumferential direction and named lifting elements because they lift the balls. The balls are effectively taken along by these lifting elements in direction of rotation of the ball mill. The balls are thus well agitated and a strong grinding action is obtained within the heap of balls. The top-most balls are thrown downward and shall impinge the ball train. The impinging balls result in an impact effect, so that the coarse proportion of the charge to be ground becomes crushed. In this arrangement, however, the contact between the balls and the internal lining is a point contact. This has as a result that an only low or even no grinding action is obtained between the balls and the internal lining. The balls immediately contact the bare internal lining and a strong noise is thus generated. In both cases, i.e. in an arrangement having an internal lining provided with riffles as well as in an arrangement having an internal lining provided with lifting elements, grinding action is unsatisfactory.

It is an object of the invention to improve the grinding effect. For solving this task, the invention essentially consists in the combination of the features, individually known per se, that the internal lining has riffles approximately extending in circumferential direction and has further webs located between the riffles and that there are provided elevations and/or depressions transversely arranged relative to the circumferential direction. In this arrangement, the riffles may extend exactly in circumferential direction or even approximately in circumferential direction along helical lines. On account of the inventive arrangement, the advantages of an internal lining having riffles extending in circumferential direction are combined with the advantages of an internal lining having lifting elements without having to put up with the drawbacks of these both constructions. A layer of the charge to be ground is located between the riffles and the balls forming the outermost layer of the heap of balls. A fine grinding of the charge to be ground is thus achieved and the noise generation is substantially reduced. On account of the lifting element, the balls are —together with the charge to be ground —lifted to a greater extent in the direction of rotation of the ball mill. The balls and the charge to be ground are thus stronger agitated within the heap of balls, so that the less fine grinding is improved within the heap of balls. The respective topmost balls are thrown down onto the ball train during rotation. The thus resulting impact action results in crushing the coarse proportion of the charge to be ground resting —on account of its low specific weight—on the heap of balls and further results in enhancing agitation of the balls within the heap of balls. Within the heap of balls, the charge to be ground is coarsely ground between the balls and between the internal lining and the balls the charge to be ground is finely ground within the riffles. In total, the grinding effect is improved, the wear of the internal lining is reduced and a noise reduction is achieved.

According to the invention, the elevations and/or depressions are preferably provided on the base of the riffles and/or on the webs. On account of the depressions and/or elevations being provided on the riffle base and/or on the webs, the balls are lifted to a greater extent in direction of rotation of the ball mill. The agitating of the heap of balls is improved and the impact action of the balls impinging the ball train is utilized for grinding purposes. According to a preferred embodiment of the invention, the riffle base and/or the ridges of the webs are undulated in direction of the riffles. The undulated arrangement of the riffle base and/or of the ridges of the webs provides the possibility to lift the balls for a greater extent but simultaneously provides the advantage that the balls are quietly running within the riffle profiles and this without disturbing shocks, so that fine grinding within the riffles can be completed. The arrangement is preferably such that the elevations and/or depressions and the undulations on the riffle base, respectively, extend in the same sense as extend the elevations and/or depressions on the ridges of the webs and are located on identical generatrices of the internal lining. This results in the advantage that the depth of the riffle is maintained approximately constant in spite of the elevations and depressions, so that the balls are kept guided within the riffles. According to a preferred embodiment of the invention, the riffles have a constant transverse profile over the whole circumference of the internal lining. The charge to be ground and located within the riffles is thus uniformly ground over the whole length of the riffles. The intermediate layer formed between the balls and the riffles by the charge to be ground becomes not interrupted. The noise—attenuating layer formed by the charge to be ground is maintained intact and on account of the undulated shape of the riffle base and of the ridges of the webs, the balls are reliably taken along during rotation. The balls impinging the ball train generate, of course, some noise, but noise generation is substantially reduced by the layer of the charge to be ground located within the riffles.

As a rule, the internal lining is composed of individual plate members, so-called armor plates. The plate members contacting one another in circumferential direction result in a type of arching in which these plate members are maintained in their position. In such type of internal lining, the plate members are, according to a preferred embodiment of the invention, subdivided within the area of the depressions and the crests of the undulations, respectively. Of course, the plate members have a greater thickness within the area of the wave crests than within the area of the wave troughs. On account of subdividing the plate members within the area of the wave crests, the arching effect is improved by the greater thickness of the plate members. This is of particular advantage in connection with an internal lining comprising no screws, because in such a screw-less construction the plate members are fixed to the wall of the tubular mill by solely utilizing the arching action.

In the drawing, the invention is schematically illustrated by means of an example of embodiment.

Figure 5:
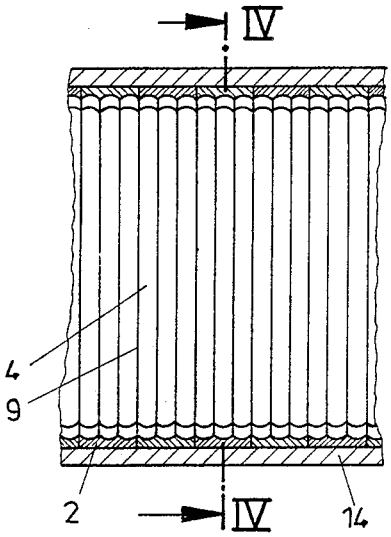

The drawing shows an armor plate for establishing the internal lining of a tubular mill, FIG. 1 showing a section along line I—I of FIG. 2, FIG. 2 showing a top-plan view in direction of arrow II of FIG. 1, FIG. 3 showing a section along line III—III of FIG. 2, FIGS. 4 and 5 showing a tubular mill comprising the internal lining, noting that FIG. 4 shows a section along line IV—IV of FIG. 5 and FIG. 5 shows a longitudinal section along line V—V of FIG. 4.

The outer side 1 of the armor plates 2 is cylindrical and has a radius corresponding to the inner radius of curvature of the housing of the tubular ball mill. The inner side 3 of the armor plate 2 has riffles 4, the base 5 of which is undulated in circumferential direction thereby forming transversely spaced apart elevations. Within the area of the wave crest 6, the armor plate 2 has a greater thickness than within the area of the wave trough 7. The ridges 8 of the webs 9 located between the riffles 4 are equally undulated to form spaced apart elevations and extend, according to the section represented by FIG. 1, equidistant relative to the riffle base 5. The transverse profile 10 (i.e. the surface generated by angularly successive axially extending generatricies) of the riffles 4 is constant over the whole circumference of the internal lining and over the whole length of the riffle 4, respectively. At the the side edges 11, the web 9' has only half of the width, because these lateral edges adjoin the adjacent armor plate 2. The front surfaces 12 delimiting the armor plate 2 in circumferential direction are inclined and extend in radial direction to the axis of the tubular ball mill. When assembling these armor plates 2, there results an arching effect which is particularly stressed on account of the front surfaces 12 being arranged within the area of the wave crests 6.

13 is a bore for screwing the armor plates 2 to the wall of the tubular ball mill. This bore 13 can, however, be omitted on account of the great thickness of the armor plates 2 within the area of the wave crests 6, in which case the armor plates 2 are fixed within the housing of the tubular ball mill solely by the arching effect.

FIGS. 4 and 5 show the tubular mill or ball mill, respectively, in a cross section and in a longitudinal section. Within the drum-shaped housing 14, which is driven for being rotated in the sense of the arrow 15, there is arranged the internal lining 16 being assembled of armor plates 2 shown in FIGS. 1 to 3. These armor plates 2 cover the whole internal wall of the drum-shaped housing 14. The riffles 4 extend over the whole internal circumference, and the spaced apart elevations formed by the wave crests 6 and the wave troughs 7 form the lifting elements which take along the heap 17 of balls in direction 15 of rotation. The surface formed by the heap 17 of balls during rotation is indicated by a dashed line 18. The heap of balls is approximately lifted up to a level 19. The balls fall downward from this level 19 and impinge the ball train indicated by the reference numeral 20.

What is claimed is:

1. An internal lining for cylindrical ball mills, characterized by the combination of a plurality of riffles each extending approximately in the circumferential direction of the ball mill internal lining with spacing between them axially of the ball mill internal lining and a plurality of webs located between respective axially-neighboring ones of the riffles and that there are provided elevations spaced apart in said circumferential direction along at least one of said plurality of riffles and said plurality of webs; said riffles each having a base extending in said circumferential direction and located intermediate the extent of such riffle axially of said ball mill internal lining; each riffle having, on said base thereof, its greatest radial distance from the longitudinal axis of said ball mill internal lining, for each generatrix, axially of said ball mill internal lining, of such riffle.

2. An internal lining as in claim 1, characterized in that said bases of said riffles have said spaced apart elevations.

3. An internal lining as in claim 1, characterized in that said bases of said riffles undulate in said circumferential direction, thereby forming said elevations.

4. An internal lining as in claim 1, characterized in that said webs undulate in said circumferential direction, thereby forming said elevations.

5. An internal lining as in claim 1, characterized in that both said riffles and said webs have said spaced apart elevations and that corresponding ones of these elevations are located on the same generatrix axially of the ball mill internal lining.

6. An internal lining as claimed in claim 1, characterized in that the riffles each have a constant transverse profile axially of the ball mill internal lining throughout the circumference of the ball mill internal lining.

7. An internal lining as in claim 1, composed of a plurality of individual plate members arranged edge-to-edge, characterized in that at least some of said plate members have corresponding adjoining edges which extend axially of said ball mill internal lining and divide into two parts respective ones of said elevations.

* * * * *